US006756556B2

(12) United States Patent
Kubota et al.

(10) Patent No.: US 6,756,556 B2
(45) Date of Patent: Jun. 29, 2004

(54) OSCILLATING SWITCH

(75) Inventors: Minoru Kubota, Shizuoka (JP); Yasuyoshi Serizawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/987,634

(22) Filed: Nov. 15, 2001

(65) Prior Publication Data

US 2002/0060611 A1 May 23, 2002

(30) Foreign Application Priority Data

Nov. 17, 2000 (JP) ..... P2000-351273

(51) Int. Cl.[7] ..... H01H 23/00
(52) U.S. Cl. ..... 200/556; 200/517; 200/557
(58) Field of Search ..... 200/556, 557, 200/6 A, 339, 517, 553

(56) References Cited

U.S. PATENT DOCUMENTS 5,496,977 A * 3/1996 Date et al. ..... 200/6 A
5,698,825 A * 12/1997 Karasik ..... 200/6 A X
5,803,243 A * 9/1998 Nestor et al. ..... 200/556

FOREIGN PATENT DOCUMENTS

| | | | | |
|---|---|---|---|---|
| DE | 41 04 572 C2 | | 8/1991 | |
| DE | 195 14 653 A1 | | 10/1995 | |
| DE | 196 19 124 A1 | | 11/1997 | |
| GB | 2277199 A | * | 10/1994 | ..... H01H/23/14 |
| JP | 2792571 | | 10/1991 | ..... H01H/23/30 |
| WO | WO 97/21236 A1 | | 6/1997 | |

* cited by examiner

*Primary Examiner*—Renee Luebke
(74) *Attorney, Agent, or Firm*—Sughrue Mion, PLLC

(57) ABSTRACT

An oscillating switch includes: a lower casing; a contact circuit member provided on the lower casing and including a through hole; a rubber switch member provided on the contact circuit member and including a pair of rubber contact portions and a through hole; an upper casing for covering the rubber switch member; an operating knob pivotally supported by the upper casing; pressing portions formed on the operating knob so as to depress the corresponding rubber contact portions, respectively; and a click feeling-producing mechanism, for producing a suitable click feeling when the operating knob is operated, which passing through the through holes of the contact circuit member and the rubber switch member.

5 Claims, 3 Drawing Sheets

OSCILLATING SWITCH

BACKGROUND OF THE INVENTION

The present invention relates to an oscillating switch, more particularly to an improved oscillating switch provided with a click feeling-producing mechanism for producing a suitable click feeling when an operating knob is operated.

As a switch for controlling various electric equipments (such as a power window mechanism) mounted, for example, on a door trim of a car door, a related oscillating switch 60 as shown in FIG. 3 is known, which includes an oscillating switch 60 of the see-saw type in which an operating knob 61 is supported for pivotal movement about a support shaft 63 on a switch panel.

In this oscillating switch 60, a PCB (printed circuit board) 66 serving as a contact circuit member is provided between an upper casing 64 and a lower casing 65 spaced a predetermined distance $T_1$ from each other. A pair of juxtaposed right and left switching elements 67 are fixedly mounted on the PCB 66.

A pair of pressing portions 68, corresponding respectively to the switching elements 67, are formed on and project from a reverse surface (lower surface in FIG. 3) of the operating knob 61, and the switching elements 67 are suitably pressed respectively by these pressing portions when the operating knob 61 is operated to be pivotally moved. A click feeling-producing mechanism (not shown) is provided within each switching element 67, and produces a suitable click feeling when the operating knob 61 is operated.

FIG. 4 shows another example of oscillating switch in which there is provided a click feeling-producing mechanism 79 separate from switching elements.

More specifically, in this oscillating switch 70, a PCB 73 serving as a contact circuit member is provided between an upper casing 71 and a lower casing 72 spaced a predetermined distance $T_2$ from each other, and a rubber switch member 75 having rubber contact portions 74 is provided on the PCB 73.

When an operating knob 76 is pressed to be pivotally moved, one of a pair of pressing portions 77 and 77 formed on and projecting from a reverse surface (lower surface in FIG. 4) of the operating knob 76 depresses corresponding one of a pair of pressing pins 78 and 78, so that the corresponding rubber contact portions 74 of the rubber switch member 75 can be depressed. The rubber contact portion 74, thus pressed by the pressing pin 78, is buckled, so that a conductive piece (not shown) thereof is pressed against a switch contact, provided on the PCB 73, to close it.

The click feeling-producing mechanism 79 is provided between the reverse surface of the operating knob 76 and the upper casing 71, and includes a ball plunger 82 which is mounted on a mounting portion of the upper casing 71 and has a compression spring 81 urging a steel ball (pressing element) 80 in a direction (upward direction in FIG. 4) toward the reverse surface of the operating knob 76, and an operating portion 83 having a cam surface 83*a* which is held in sliding contact with the steel ball 80 so as to guide the same. When the operating knob 76 is operated, the click feeling-producing mechanism 79 produces a suitable click feeling of the operating knob 76 in accordance with a resistance of sliding contact between the steel ball 80 of the ball plunger 82 and the cam surface 83*a* of the operating portion 83.

In the related oscillating switch 60 shown in FIG. 3, the click feeling-producing mechanism is contained in the switching element 67, so that the height (the dimension in the upward-downward direction in FIG. 3) of the switching element 67 increases. Therefore, the switching elements 67 must be firmly fixed to the PCB 66, so that a gap $\alpha$ for receiving soldering leads of the switching elements 67 and snap-fit members thereof must be provided between the PCB 66 and the lower casing 65.

Therefore, it is difficult to reduce the spacing $T_1$ between the upper casing 64 and the lower casing 65 in the oscillating switch 60, and a dimension $X_1$ of a unit in the direction of its thickness (that is, the spacing between the upper casing 64 and the lower casing 65; the dimension in the upward-downward direction in FIG. 3) can not be reduced. Therefore, there was encountered a problem that it was difficult to achieve a thin design of the whole of the unit and a space-saving effect when the unit is mounted on a vehicle.

On the other hand, in the oscillating switch 70 shown in FIG. 4, the click feeling-producing mechanism 79 separate from the switching elements is provided between the operating knob 76 and the outer surface of the upper casing 71, and the rubber switch member 75 is adopted. Therefore, the spacing $T_2$ between the upper casing 71 and the lower casing 72 in the oscillating switch 70 can be made smaller as compared with the oscillating switch 60 shown in FIG. 3.

However, the height $H_2$ of projecting of the operating knob 76 from the outer surface of the upper casing 71 is considerably larger than the height Hi of projecting of the operating knob 61 of the oscillating switch 60 shown in FIG. 3.

Namely, the click feeling-producing mechanism 79 is provided between the operating knob 76 and the outer surface (upper surface in FIG. 4) of the upper casing 71, and the spacing between a support shaft 84, serving as an axis of pivotal movement of the operating knob 76, and each rubber contact portion 74 of the rubber switch member 75 is large. Therefore in order that each rubber contact portion 74 can be properly pressed, the pressing pin 78 needs to be interposed between the operating knob and the rubber contact portion 74.

Therefore, the pressing pins 78 are fitted respectively in guide portions 71*a* formed integrally on the upper casing 71 so as to move upward and downward, so that these guide portions 71*a* need to have a predetermined guide length (dimension in the upward-downward direction in FIG. 4) As a result, the dimension $X_2$ of the whole of the unit in the direction of thickness thereof (that is, the spacing between the upper casing 71 and the lower casing 72; the dimension in the upward-downward direction in FIG. 4) can not be reduced. Therefore, as in the oscillating switch 60 of FIG. 3, there was encountered a problem that it is difficult to achieve a thin design of the whole of the unit (for example, a space-saving effect when the unit is mounted on a vehicle).

SUMMARY OF THE INVENTION

It is therefore an object of this invention to solve the above problems and to provide an oscillating switch which can achieve a thin design of the whole of a unit while securing a good click feeling when operating an operating knob.

In order to solve the aforesaid object, the invention is characterized by having the following arrangement.

(1) An oscillating switch comprising:

a lower casing;

a contact circuit member provided on the lower casing and including a through hole;

a rubber switch member provided on the contact circuit member and including a pair of rubber contact portions and a through hole;

an upper casing for covering the rubber switch member;

an operating knob pivotally supported by the upper casing;

pressing portions formed on the operating knob so as to depress the corresponding rubber contact portions, respectively; and a click feeling-producing mechanism, for producing a suitable click feeling when the operating knob is operated, which passing through the through holes of the contact circuit member and the rubber switch member, wherein the click feeling-producing mechanism includes, a cam surface formed on one of the operating knob and the lower casing, a pressing element formed on the other of the operating knob and the lower casing, and a urging member for urging the pressing element to the cam surface.

(2) The oscillating switch according to (1), wherein the cam surface is formed on a distal end of an operating portion which projects from the operating knob and passes through the through holes of the contact circuit member and the rubber switch member, and the urging member is received and held in a receiving recess in the lower casing.

In the above construction, the contact circuit member and the rubber switch member are provided on the lower casing, and the click feeling-producing mechanism is interposed between the operating knob and the lower casing, and extends through the contact circuit member and the rubber switch member. Therefore, the spacing between the upper casing and the lower casing can be reduced.

When the spacing between the upper casing and the lower casing is reduced, the distance between the axis of pivotal movement of the operating knob and each of the rubber contact portions of the rubber switch member can be reduced, and therefore any separate members, such as pressing pins, are not necessary for properly pressing the rubber contact portions, and the number of the component parts is reduced, and besides the provision of guide portions, having a predetermined guide length so as to respectively guide the pressing pins, is not necessary, and the height of projecting of the operating knob from the outer surface of the upper casing can be reduced.

Therefore, only those portions, corresponding respectively to the click feeling-producing mechanisms, project a minimum distance from the outer surface of the lower casing, and a thin design of the whole of a switch unit can be easily achieved while securing a good click feeling when operating the operating knob.

DETAILED DESCRIPTION OF PREFERRED EMBODIMENTS

One preferred embodiment of an oscillating switch of the present invention will now be described in detail with reference to the accompanying drawings.

Figure 1:
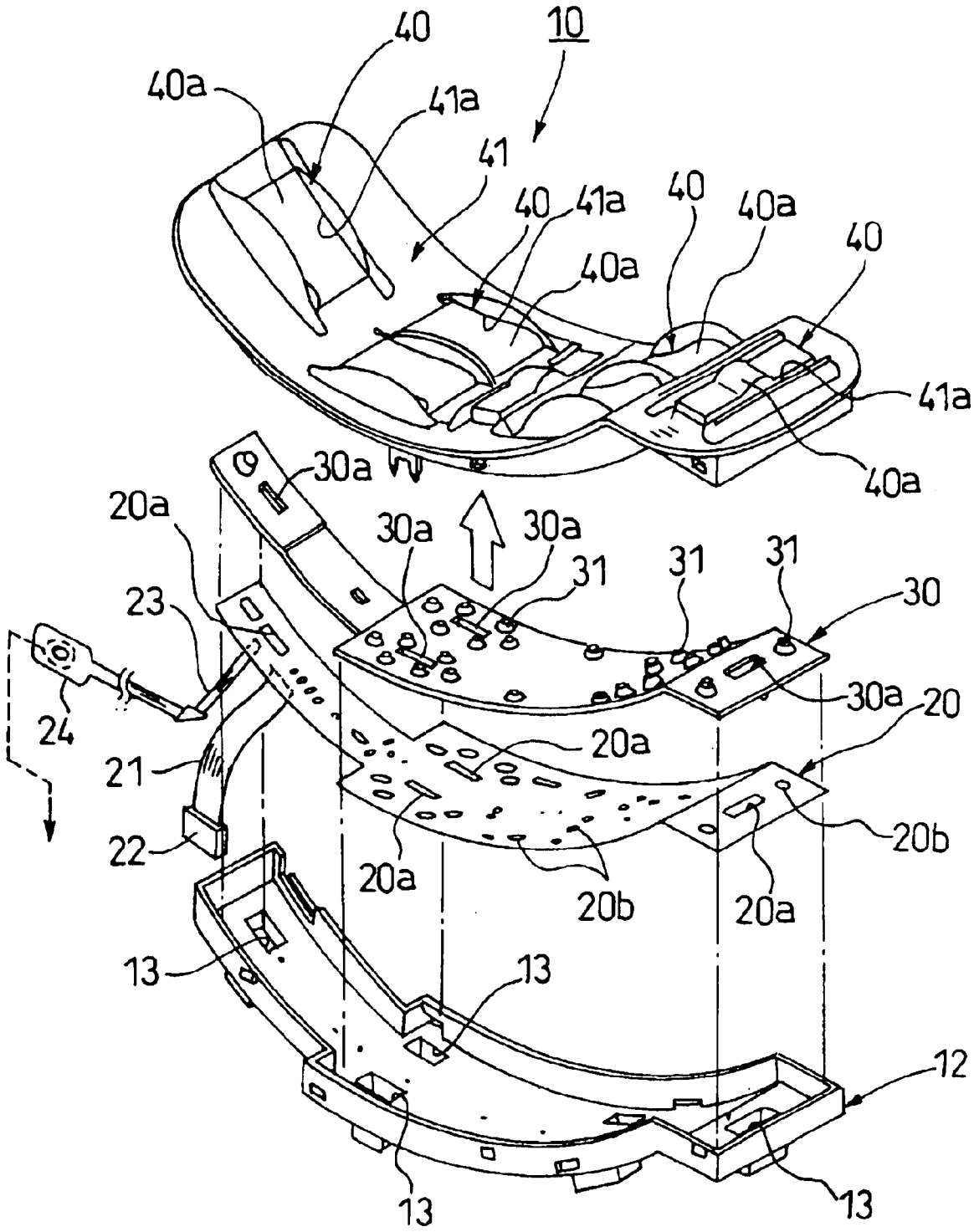
FIG. 1 is an exploded, perspective view of a power window switch unit provided with one preferred embodiment of oscillating switches of the invention.
Figure 2:
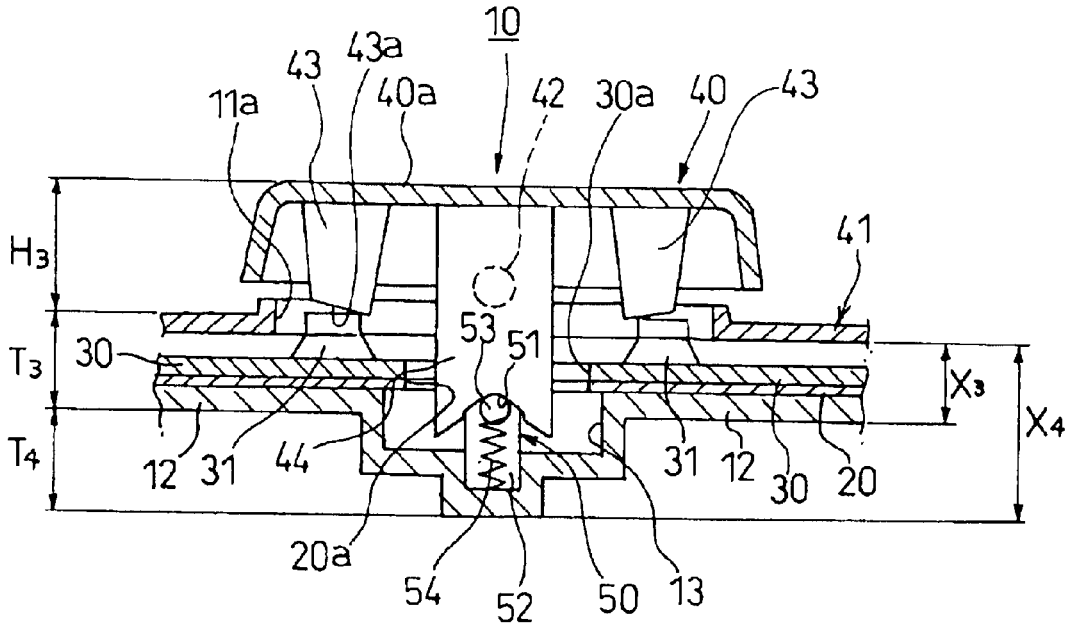
FIG. 2 is a vertical cross-sectional view of an important portion of the oscillating switch shown in FIG. 1.
Figure 3:
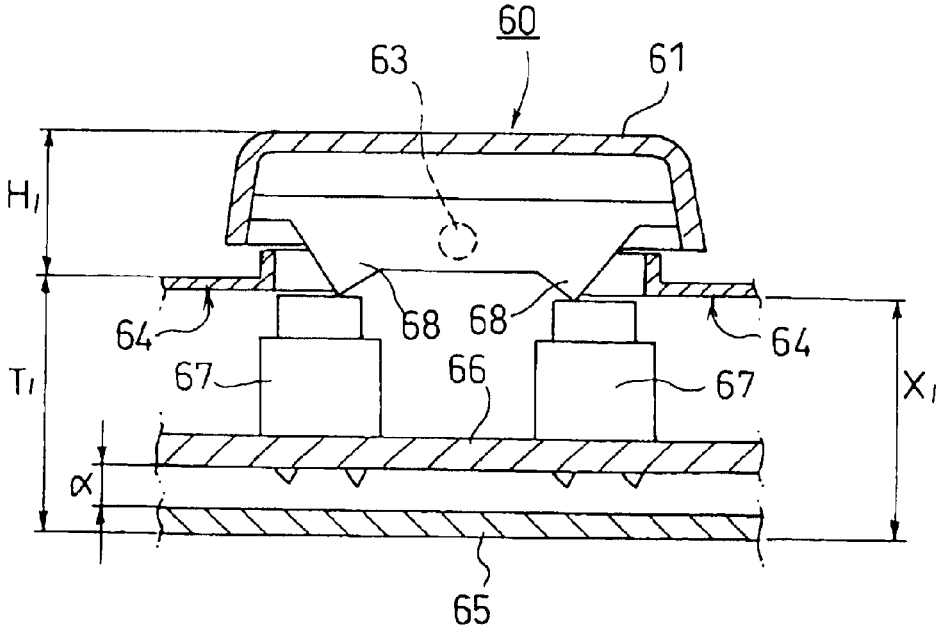
FIG. 3 PRIOR ART
FIG. 3 a vertical cross-sectional view of an important portion of a related oscillating switch.

FIG. 1 is an exploded perspective view of a power window switch unit provided with using the oscillating switches according to the first embodiment of the present invention, and FIG. 2 is a vertical cross-sectional view of an important portion of the oscillating switch shown in FIG. 1.

The power window switch unit 10 shown in FIG. 1 is a switch unit which is mounted on a door trim of a car door and controls a power window drive mechanism and a courtesy lamp mechanism (not shown) or the like. This power window switch unit includes: an FPC (flexible printed circuit) 20 provided on an inner surface of a lower casing 12 formed into a predetermined curved shape; a rubber switch member 30 including a plurality of pairs of rubber contact portions 31 and 31, and superposed on the FPC 20; and an upper casing 41 covering the rubber switch member 30.

The plurality of oscillating switches 40 are arranged on an upper surface of the upper casing 41. Each of these switches, provided respectively in openings 41*a* formed in the upper casing 41, includes an operating knob 40*a* pivotally supported on a support shaft 42, and a click feeling-producing mechanism 50 for producing a suitable click feeling of the operating knob 40*a*.

The FPC 20 is a film-like contact circuit member having flexibility, and is made, for example, of a polyethylene terephthalate (PET) resin, and has a circuit pattern (not shown) formed thereon. In this embodiment, the FPC 20 forms electric circuits for controlling the power window mechanism and the courtesy lamp mechanism or the like, and is electrically connected to the power window mechanism through an input/output signal line portion 21 and a connector 22, and is also electrically connected to the courtesy lamp mechanism through an input/output signal line portion 23 and a lamp circuit board 24.

The plurality of rubber contact portions 31 and 31, corresponding respectively to switch contacts 20*b* on the circuit pattern formed on the FPC 20, are formed integrally on the rubber switch member 30. A conductive piece (not shown), provided in the rubber contact portion 31, is pressed against the switch contact 20*b* opposed thereto, thereby closing the circuit.

As shown in FIG. 2, a pair of pressing portions 43 and 43 are formed on a reverse surface (lower surface in the drawings) of the operating knob 40*a* so as to press the corresponding rubber contact portions 31, respectively, in accordance with the pivotal movement of the operating knob 40*a*.

A distal end surface 43*a* of the respective pressing portions 43 is cut into a slanting angle corresponding to an angle of pivotal movement of the operating knob 40*a*, and can be properly held in contact with the corresponding rubber contact portion 31 in a fully pivotally-moved condition of the operating knob 40*a*.

An operating portion 44 is formed on and projects from a generally central portion of the reverse surface of each operating knob 40*a*. The operating portion 44 passes through a through hole 30*a* formed through the rubber switch member 30 and a through hole 20*a* formed through the FPC 20, and extends into a receiving recess 13 formed in the lower casing 12. A cam groove 51, having a cam surface constituting the click feeling-producing mechanism 50 (described later), is formed in a distal end of the operating portion 44.

The click feeling-producing mechanism 50 for producing a suitable click feeling when operating the operating knob 40*a* includes the cam groove 51, and a ball plunger 52 received and held in the receiving recess 13.

The cam groove 51 is a groove of a generally V-shaped cross-section extending along the axis of pivotal movement of the operating knob 40*a*.

The ball plunger 52 includes a compression coil spring (urging means) 54 which is received in the receiving recess 13 in the lower casing 12, and resiliently urges a steel ball (pressing element) 53 toward the cam surface of the cam groove 51.

By displacement of the operating portion 44 in accordance with the pivotal movement of the operating knob 40*a*, a suitable click feeling is obtained by the friction between the steel ball 53 and the cam surface of the cam groove 51.

Instead of the steel ball 53, a slide pin may be used as the pressing element.

Next, the operation of the oscillating switch 40 of this embodiment will be described.

When the operating knob 40*a* of the oscillating switch 40 is pressed to be pivotally moved in one direction, the pressing portion 43 formed on and projecting from the reverse surface of the operating knob 40*a* presses the corresponding rubber contact portion 31. The rubber contact portion 31, thus pressed, is buckled, so that the conductive piece thereof is pressed against the switch contact 20*b* on the FPC 20, thereby closing the circuit.

At this time, as a result of displacement of the operating portion 44 in accordance with the pivotal movement of the operating knob 40*a*, a suitable click feeling is obtained by the friction between the steel ball 53 and the cam surface of the cam groove 51 of the click feeling-producing mechanism 50.

Namely, in the oscillating switch 40 of this embodiment, the FPC 20 and the rubber switch member 30 are provided on the lower casing 12, and the click feeling-producing mechanism 50 is interposed between the operating knob 40*a* and the lower casing 12 in such a manner that this mechanism 50 passes through the through holes 20*a* and 30*a* formed respectively through the FPC 20 and the rubber switch member 30. Therefore, the spacing $T_3$ between the upper casing 41 and the lower casing 12 can be reduced, and a dimension $X_3$ of the major portion of the switch unit in the direction of the thickness thereof can be reduced.

Figure 4:
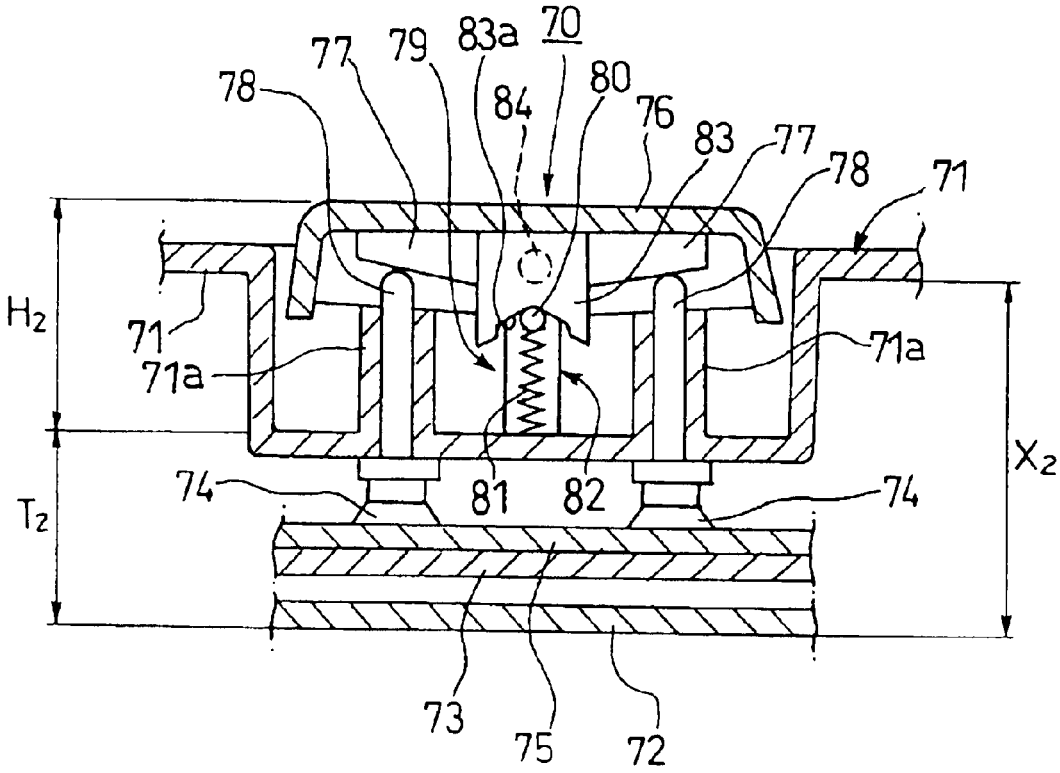
FIG. 4 PRIOR ART
FIG. 4 is a vertical cross-sectional view of an important portion of another related oscillating switch.

When the spacing $T_3$ between the upper casing 41 and the lower casing 12 is reduced, the distance between the axis of pivotal movement (the support shaft 42) of the operating knob 40*a* and each of the corresponding rubber contact portions 31 of the rubber switch member 30 can be reduced. Therefore any separate members, such as the pressing pins 78 in the related oscillating switch 70 of FIG. 4, are not necessary for properly pressing the rubber contact portions 31.

Therefore, in the oscillating switch 40 of this embodiment, the number of the component parts is smaller as compared with the related oscillating switch 70, and the provision of the guide portions 71*a* for respectively guiding the pressing pins 78 is not necessary, and further the height $H_3$ of projecting of the operating knob 40*a* from the outer surface of the upper casing 41 can be reduced.

Incidentally, the outer surface (lower surface in FIG. 2) of the lower casing 12 projects convexly at those regions at which the receiving recesses 13 are formed, respectively. Therefore, a dimension $X_4$ of these portions of the switch unit in the direction of the thickness thereof is increased. However, part of the switch unit, that is, only those portions, corresponding respectively to the click feeling-producing mechanisms 50, project to a minimum degree.

Therefore, the substantial dimension $X_3$ of the power window switch unit 10 in the direction of the thickness thereof can be reduced while securing a good click feeling when operating the operating knob 40*a*, and a thin design of this switch unit for space-saving purposes can be easily achieved. Therefore, the good ability thereof to be mounted on the vehicle can be obtained.

The constructions of the contact circuit member, the rubber switch member, the operating knob, the click feeling-producing mechanism and soon of the oscillating switch of the present invention are not limited to those of the above embodiment, and each of them can take any of various forms on the basis of the subject matter of the present invention.

For example, in the above embodiment, although the film-like FPC 20 is used as the contact circuit member, other contact circuit member, such as a PCB, can be used. Further, by suitably setting the cam surface, the urging means and so on of the click feeling-producing mechanism, the amount of projecting of the convex portions from the outer surface of the lower casing 12 can be made smaller.

As described above, in the oscillating switch of the present invention, the contact circuit member and the rubber switch member are provided on the lower casing, and the click feeling-producing mechanism is interposed between the operating knob and the lower casing, and extends through the contact circuit member and the rubber switch member. Therefore, the spacing between the upper casing and the lower casing can be reduced.

When the spacing between the upper casing and the lower casing is reduced, the distance between the axis of pivotal movement of the operating knob and each of the rubber contact portions of the rubber switch member can be reduced, and therefore any separate members, such as pressing pins, are not necessary for properly pressing the rubber contact portions, and the number of the component parts is reduced, and besides the provision of guide portions, having a predetermined guide length so as to respectively guide the pressing pins, is not necessary, and the height of projecting of the operating knob from the outer surface of the upper casing can be reduced.

Therefore, only those portions, corresponding respectively to the click feeling-producing mechanisms, project a minimum distance from the outer surface of the lower casing, and a thin design of the whole of the switch unit can be easily achieved while securing a good click feeling when operating the operating knob.

What is claimed is:

1. An oscillating switch comprising:

a lower casing;

a contact circuit member provided on the lower casing and including a first through hole;

a rubber switch member provided on the contact circuit member and including a pair of rubber contact portions and a second through hole;

an upper casing for covering the rubber switch member;

an operating knob pivotally supported by the upper casing;

pressing portions formed on the operating knob for depressing the corresponding rubber contact portions, respectively; and a click feeling-producing mechanism, for producing a suitable click feeling when the operating knob is operated, which passes through the first and second through holes, wherein the click feeling-producing mechanism includes, a cam surface formed on one of the operating knob and the lower casing, a pressing element formed on the other of the operating knob and the lower casing, and a urging member for urging the pressing element to the cam surface, wherein the cam surface is formed on a distal end of an operating portion which projects from the operating knob and passes through the first and second through holes, and the urging member is received and held in a receiving recess in the lower casing.

2. The oscillating switch according to claim 1, wherein the operating portion projects from a central portion of the operating knob.

3. The oscillating switch according to claim 1, wherein the cam surface has a v-shaped cross-section along an axis of pivotal movement of the operating knob.

4. An oscillating switch comprising:

a lower casing;

a contact circuit member provided on the lower casing and including a first through hole;

a rubber switch member provided on the contact circuit member and including a pair of rubber contact portions and a second through hole;

an upper casing for covering the rubber switch member;

an operating knob pivotally supported by the upper casing;

pressing portions formed on the operating knob for depressing the corresponding rubber contact portions, respectively; and a click feeling-producing mechanism, for producing a suitable click feeling when the operating knob is operated, which passes through the first and second through holes, wherein the click feeling-producing mechanism includes, a cam surface formed on one of the operating knob and the lower casing, a pressing element formed on the other of the operating knob and the lower casing, and a urging member for urging the pressing element to the cam surface, wherein the urging member is a coil spring.

5. An oscillating switch comprising:

a lower casing;

a contact circuit member provided on the lower casing and including a first through hole;

a rubber switch member provided on the contact circuit member and including a pair of rubber contact portions and a second through hole;

an upper casing for covering the rubber switch member;

an operating knob pivotally supported by the upper casing;

pressing portions formed on the operating knob for depressing the corresponding rubber contact portions, respectively; and a click feeling-producing mechanism, for producing a suitable click feeling when the operating knob is operated, which passes through the first and second through holes, wherein the click feeling-producing mechanism includes, a cam surface formed on one of the operating knob and the lower casing, a pressing element formed on the other of the operating knob and the lower casing, and a urging member for urging the pressing element to the cam surface, wherein the pressing element consists of a steel ball.

* * * * *